United States Patent [19]

Wilson, Jr. et al.

[11] 4,254,085

[45] Mar. 3, 1981

[54] CATALYTIC CONVERTER WITH DUAL CATALYST PELLET BEDS AND REINFORCED PLENUM THEREBETWEEN

[75] Inventors: John R. Wilson, Jr., Flint; Earl W. Pierce, Grand Blanc, both of Mich.

[73] Assignee: General Motors Corporation, Detroit, Mich.

[21] Appl. No.: 128,272

[22] Filed: Mar. 7, 1980

[51] Int. Cl.[3] ..... B01J 8/04; F01N 3/28; F01N 3/34

[52] U.S. Cl. ..... 422/171; 422/172; 422/179

[58] Field of Search ..... 422/171, 172, 177, 179; 60/299

[56] References Cited

U.S. PATENT DOCUMENTS

| | | | |
|---|---|---|---|
| 3,600,142 | 8/1971 | Fessler | 422/179 |
| 3,852,041 | 12/1974 | Moore et al. | 60/299 |
| 3,927,984 | 12/1975 | Hartley | 60/299 |
| 3,963,448 | 6/1976 | Hartley et al. | 422/172 |

FOREIGN PATENT DOCUMENTS

| | | | |
|---|---|---|---|
| 1334810 | 10/1973 | United Kingdom | 422/171 |

*Primary Examiner*—Bradley Garris
*Attorney, Agent, or Firm*—R. L. Phillips

[57] ABSTRACT

In a catalytic converter, a sheet metal housing encloses a pair of sheet metal catalyst pellet beds each having an inner bed member and an outer bed member with the inner bed members having mating peripheral flanges and also forming a plenum between the beds whose air space is maintained by contacting louvers which form the air passage between the beds. A shoulder is formed integral with and extends across each of the outer bed members and is held engaged on its inner bed side with the flange on one of the inner bed members by an extension on the other inner bed member which is sandwiched between the outer bed members while the remaining portions of the mating flanges are received between flanges on the outer bed members. The inner bed members thus cooperate with the outer bed members to completely separate the pellets in the beds while relative expansion with heat is permitted between the inner bed members and the outer bed members and also between the inner bed members and the housing members and while narrowing of the air plenum is positively prevented by the louvers on the inner bed members.

2 Claims, 4 Drawing Figures

CATALYTIC CONVERTER WITH DUAL CATALYST PELLET BEDS AND REINFORCED PLENUM THEREBETWEEN

This invention relates to catalytic converters for internal combustion engine exhaust gases and more particularly to such converters of the type having a sheet metal housing enclosing a pair of sheet metal catalyst pellet beds with a plenum therebetween.

In catalytic converters of the above type, it is known to form a plenum between the inner members of the beds in addition to having these members also separate the catalyst pellets in the two beds. However, in such arrangements it has been found that relative expansion with heat between the inner bed members and the outer bed members as well as between the inner bed members and the housing members may affect the integrity of the plenum as well as separation of the pellets particularly where it is attempted to provide peripheral mating flanges on the inner bed members which are then sandwiched between flanges on the outer bed members. Heretofor, it was believed that the mating peripheral flanges on the inner bed members would need to conform completely with the flanges on the outer bed members and, therefore, require relatively complicated and extensive inner bed member shapes as well as resulting complexity at their joining to the outer bed members while permitting relative expansion with heat therebetween.

The present invention is an improvement on catalytic converters particularly of the type disclosed in copending U.S. patent application Ser. No. 033,050 filed Apr. 25, 1979 and assigned to the assignee of this invention. In the aforesaid patent application, there is disclosed a catalytic converter having a sheet metal housing comprised of a pair of housing shell members which cooperatively enclose and also provide an inlet and an outlet for a pair of sheet metal catalyst beds. Each of the beds has a perforated outer bed member cooperating with one of the housing shell members so that the inlet and outlet are directly open within the housing to the perforated area of the respective outer bed members. The outer bed members have corresponding flanges extending on opposite sides thereof between the inlet and outlet that are sandwiched between and edge welded to corresponding flanges on the housing shell members. Each of the beds also has a perforated inner bed member which cooperates with its outer bed member to retain the pellets therebetween while permitting gas flow therethrough and also cooperates with the inner bed member of the other bed to form a plenum for gas flow between the beds with air delivered thereto for mixing with the exhaust gases. To help support the inner bed members, a shoulder is formed integral with and extends across each of the other bed members outward of its perforated area and between its flanges. The inner bed members are provided with mating peripheral flanges having portions thereof clamped but slidably movable between the edge welded flanges of the outer bed members while the remaining portions of the mating inner bed member flanges are caused to engage on only their inner bed side against the respective shoulder on the outer bed members. In this way, the inner bed members cooperate with the respective outer bed members to completely separate the pellets within the beds while forming the plenum therebetween and while also permitting relative expansion with heat between the inner bed members and the outer bed members and also between the inner bed members and the housing shell members.

In catalytic converters of the above type, we have discovered that with a very simple modification of only one end of each of the inner bed members, it is possible to positively retain their flange engagement with the respective shoulder on the outer bed members and thereby positively avoid any possibility of an opening developing between the beds at these joints as a result of strength loss at high temperatures. In the preferred embodiment of the present invention, this is accomplished by a single imperforate extension which is formed integral with and extends outward from each of the inner bed members toward either the inlet or outlet. The extensions are at opposite ends of the assembled inner bed members and extend transversely of the respective inlet and outlet. The extension on each of the inner bed members has a semi-cylindrical end portion which is sandwiched between corresponding portions on the outer bed members and is clamped thereby but slidably movable with respect thereto so as to trap the other inner bed member against the shoulder which the latter engages. Thus, the inner bed members are completely peripherally supported but slidably movable between the outer bed members to positively maintain separation of the beds while permitting relative expansion thereof with heat.

These and other objects, features and advantages of the present invention will become more apparent from the following description and drawings in which.

The catalytic converter shown is for use in a vehicle to purify the exhaust gases from an internal combustion engine. The converter is of the dual-bed down-flow type with one bed retaining pellets $P_{3W}$ coated with a three-way catalyst and the other bed located downstream thereof and retaining pellets $P_O$ coated with an oxidizing catalyst and with the exhaust gases being directed downward through both beds. And it will be understood, of course, that the total bed capacity is dependent upon such factors as the catalyst, the particular engine and the emission levels sought. For example, it has been found that with presently commercially available catalysts a total bed capacity of about 138 cubic inches is suitable for use with small engines of about 3.0 liters and less and that a total bed capacity of about 250 cubic inches is suitable for use with larger engines.

Figure 1:
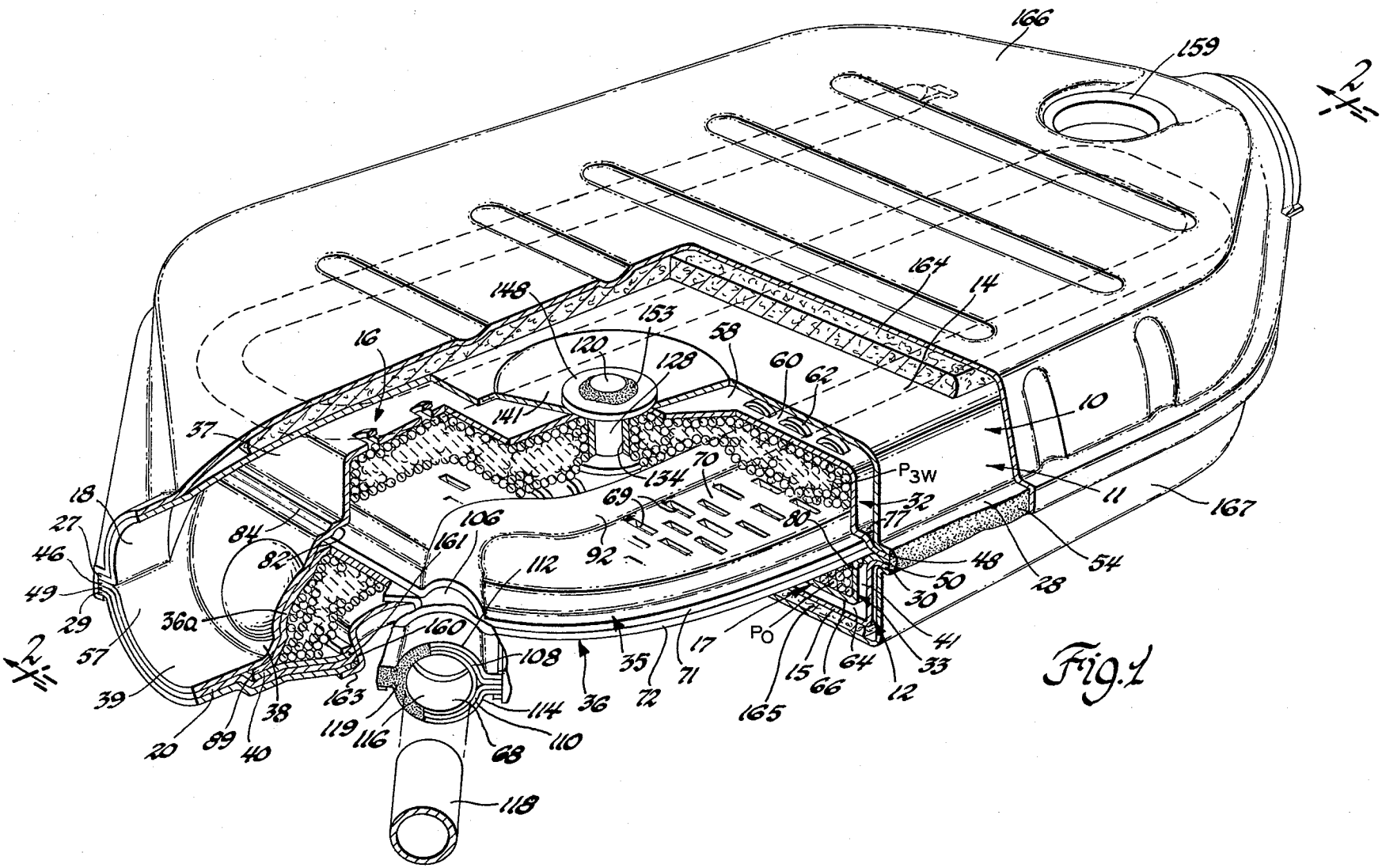
FIG. 1 is a perspective view with parts broken away of a catalytic converter embodying the preferred form of the present invention.
Figure 2:
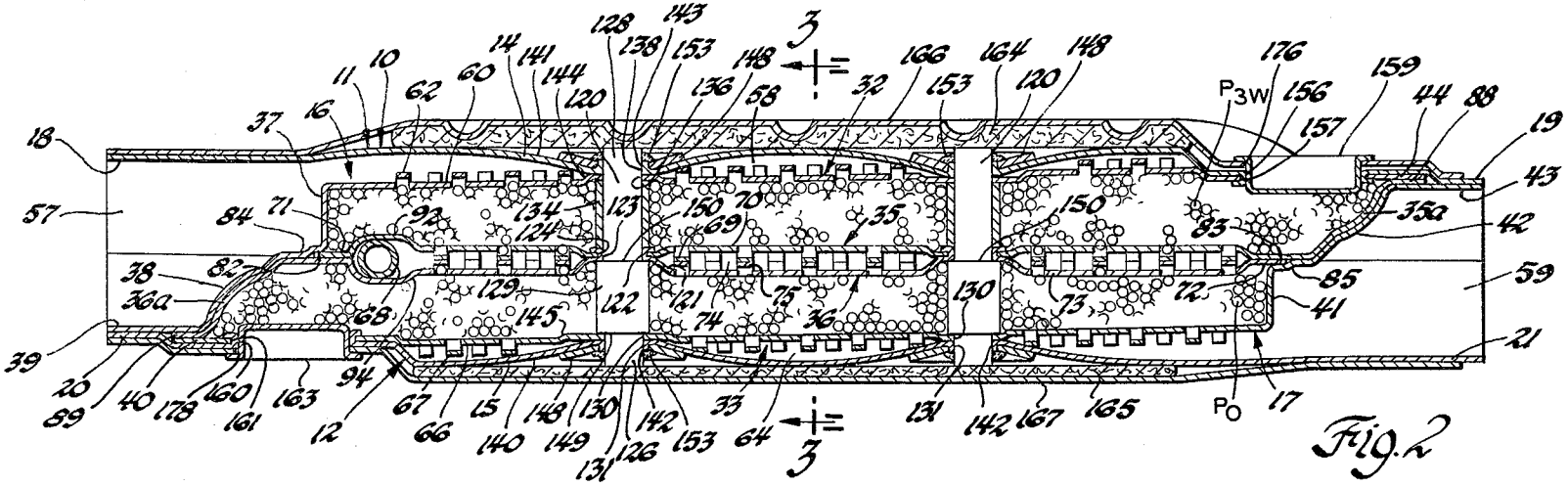
FIG. 2 is a longitudinal sectional view taken along the line 2—2 in FIG. 1.
Figure 3:
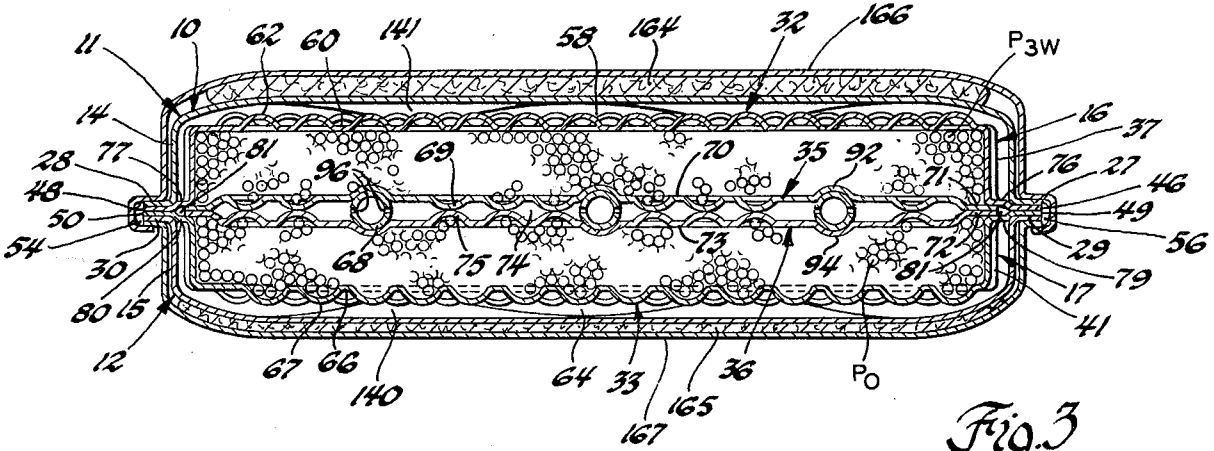
FIG. 3 is a cross-sectional view taken along the line 3—3 in FIG. 2.

As shown in FIGS. 1–3, the converter has a generally rectangular box profile and comprises a sheet metal housing 10 of the clamshell type consisting of an upper shell member 11 and a lower shell member 12 made of stainless steel. The housing shell members 11 and 12 have a body portion 14 and 15, respectively, which cooperatively enclose a pair of sheet metal catalyst beds or retainers 16 and 17 also made of stainless steel. In addition, the housing shell members 11 and 12 have semi-cylindrical neck portions 18, 19 and 20, 21, respectively, with the two neck portions 18 and 20 cooperating on their concave side to form an inlet opening in one end of the housing and the other two neck portions 19 and 21 cooperating on their concave side to form an outlet opening in the opposite end of the housing (see FIGS. 1 and 2). Then for joining together the two housing shell members and mounting the catalyst beds therebetween, the housing shell members 11 and 12 are formed with integral co-planar flanges 27, 28 and 29, 30 respectively, which extend horizontally between the housing ends along opposite sides of the respective body portion 14, 15 and neck portions 18, 19 and 20, 21 (see FIGS. 1 and 3).

The catalyst beds 16 and 17 consist of an upper and lower perforated shell member 32 and 33 and an upper and lower perforated plate member 35 and 36, respectively. The bed plate members 35 and 36 are located between or inward of the bed shell members 32 and 33 and the upper bed shell member 32 has a body portion 37 for retaining the three-way catalyst pellets $P_{3W}$ and in addition has an imperforate portion 38 at one end with a semi-cylindrical neck portion 39. The neck portion 39 nests on its convex side with the neck portion 20 on the lower housing shell member 12 and also nests inward thereof with the concave side of a semi-cylindrical neck portion 40 formed on one end of the lower bed shell member 33. In addition there is provided an extended end portion 36*a* formed on the lower bed plate member 36 which is sandwiched between the latter nesting arrangement as described in more detail later. The neck portion 40 in turn also nests on its convex side with the concave side of the neck portion 20 on the lower housing shell member 12. The lower bed shell member 33 in similar manner has a body portion 41 for retaining the oxidizing catalyst pellets $P_O$ and an imperforate portion 42 with a semi-cylindrical neck portion 43 on the lower bed shell member end opposite its neck portion 40 (see FIG. 2). The neck portion 43 nests on its convex side with the neck portion 19 on the upper housing shell member 11 and also nests inward thereof with the concave side of a semi-cylindrical neck portion 44 formed on the end of the upper bed shell member 32 opposite its neck portion 39. In addition, there is provided an extended end portion 35*a* formed on the upper bed plate member 35 which is sandwiched between the latter nesting arrangement as described in more detail later. The neck portion 44 in turn also nests on its convex side with the concave side of the neck portion 19 on the upper housing shell member 11.

In addition, the upper and lower or outer bed shell members 32 and 33 have co-planar flanges 46, 48 and 49, 50 respectively, which extend horizontally along opposite sides of their respective body portion 37, 41 and neck portions 39, 44 and 40, 43. The respective upper and lower bed shell member flanges 46, 48 and 49, 50 mate along their respective lower and upper side, except for the accommodation of an air tube between the flanges 48 and 50 as described later, and also mate along their respective upper and lower side with the respective upper and lower housing shell flanges 27, 28 and 29, 30. These flanges are thus mated in a four-layer arrangement along the opposite sides of the housing and have edges sealingly joined together external of the housing by separate welds 54 and 56.

On the other hand, the outer bed members 32 and 33 cooperate with the respective housing shell members 11 and 12 at the housing openings to direct the exhaust gases entering the housing first down through the three-way catalyst bed 16 and then down through the oxidizing catalyst bed 17 and out of the housing. At the inlet end of the converter, the neck portion 39 on the upper bed shell member 32 cooperates on its concave side with that of the neck portion 18 on the upper housing shell member 11 to provide a cylindrical converter inlet 57 adapted to receive and be edge welded to a pipe (not shown) for connecting the converter in the exhaust system to receive the exhaust gases from the engine. In addition, the outer bed side of the upper bed shell member 32 including its body portion 37 and imperforate portion 38 cooperates with the inner side of the upper housing shell member 11 to form an upper space 58 within the housing directly open to only the housing inlet 57. The imperforate portion 38 is slanted to funnel the exhaust gases upward into the space 58 and the body portion 37 has a perforated top 60 which is flat except in the area of stud openings as described later and except for the formation of a plurality of gas flow holes spaced over the area thereof formed by upwardly projecting louvers 62 which permit gas flow therethrough while retaining the pellets in the upper catalyst bed 16. Thus, the exhaust gases entering the upper space 58 in the converter through the inlet 57 are caused to flow down through the top of the upper catalyst bed 16.

In an inverse manner at the outlet end of the converter, the neck portion 43 on the lower bed shell member 33 cooperates on its concave side with that of the neck portion 21 on the lower housing shell member 12 to provide a cylindrical converter outlet 59 which is adapted to receive and be edge welded to a pipe (not shown) for conveying the purified exhaust gases from the converter into the downstream portion of the exhaust system. The outer bed side of the lower bed shell member 33 including its body portion 41 and imperforate portion 42 cooperates with the inner side of the lower housing shell member 12 to form a lower space 64 within the housing directly open to only the outlet 59. The body portion 41 has a perforated bottom 66 which is flat except in the area of stud openings as described later and except for the formation of a plurality of gas flow holes spaced over the area thereof formed by downwardly projecting louvers 67 which permit gas flow therethrough while retaining the pellets in the lower catalyst bed 17. Thus, the exhaust gases are caused to flow down through the bottom of the lower catalyst bed 17 to the lower space 64 and the imperforate portion 42 is slated to direct the gases upward therefrom to the outlet 59.

Furthermore, it will be seen in FIG. 3 that the outer bed member body portions 37, 41 have vertical imperforate sides which are spaced inward from vertical sides of the respective housing member body portions 14, 15 and that the corresponding vertical sides of the respective bed member body portions and housing member body portions are vertically aligned. In addition, it will be seen in FIG. 2 that the opposite sides of the outer bed member body portions 37 and 41 are evenly tapered in height but in opposite directions so that the perforated top 60 of the upper catalyst bed 16 is slanted upward to gradually decrease the overhead flow area in the upper space 58 in the direction of the entering gas flow into the upper bed while the perforated bottom 66 of the lower catalyst bed 17 is slanted in the same direction and parallel to the top 60 of the upper bed to gradually increase the underneath flow area in the lower space 64 in the direction of the exiting gas flow from the lower bed. With such arrangement, the total depth of the pellets in the two beds 16 and 17 is made uniform there-across and that coupled with the oppositely tapered flow areas above and below effects substantially even distribution of the gas flow across the flow area of both beds.

The pellets $P_{3W}$ and $P_O$ in the two beds are separated and a plenum is provided therebetween for air injection from a round air tube 68 by the two perforated inner bed members 35 and 36 cooperating with each other and with the outer bed members 11 and 12. Furthermore, the inner bed members 35 and 36 are peripherally mounted so that they are firmly supported completely thereabout by the outer bed members 11 and 12 and the housing shell members 11 and 12 while relative expansion with heat is permitted therebetween to maintain their sealed integrities.

The upper bed plate member 35 has downwardly projecting louvers 69 which are located in an upwardly displaced or recessed flat perforated portion 70 inward of a peripheral flange 71 and permit gas flow therethrough while retaining the pellets in the upper catalyst bed 16. The flange 71 on the upper bed plate member mates along its lower side with the upper side of a peripheral flange 72 formed on the lower bed plate member 36 and these flanges are spot-welded together at spaced points along their length after piloted assembly with the air tube 68 therebetween and flanged connection of the inner bed members as described in detail later. The lower bed plate member 36 inward of its peripheral flange 72 has a flat perforated portion 73 which is displaced or recessed downward and thus away from the lower side of the upwardly recessed perforated portion 70 of the upper bed plate member 35 to provide in cooperation therewith an air space or plenum 74 therebetween and thus between the two catalyst beds 16 and 17 for air injection into the downwardly passing exhaust gases. The perforated portion 73 in the lower bed plate member 36 has upwardly projecting louvers 75 which permit gas flow therethrough while retaining the pellets in the lower catalyst bed 17.

Moreover, the louvers 69 and 75 on the respective inner bed plate members 35 and 36 are located directly opposite each other and are provided with a height extending to the plane of their engagement along their flanges 71 and 72 so that the crests of the oppositely projecting louvers 69 and 75 contact to thereby maintain the desired air space or distance in the plenum between the inner bed plate members over their entire flat perforated portions 70 and 71. This has been found to provide a very significant improvement in strength to prevent narrowing or collapse of the air space under extreme pressure and temperature conditions. Furthermore, it will be seen at this point that the louvers in all the bed members extend transversely thereof with the louvers in the upper bed shell member thus extending transverse to the entering exhaust gases while the louvers in the lower bed shell member extend transverse to the exiting exhaust gases.

The inner bed members 35 and 36 are supported, but not fixed, completely along the longitudinal portions of their mating flanges 71 and 72 between the respective outer bed member flanges 46, 49 and 48, 50 and inward of the respective housing shell member flanges 27, 29 and 28, 30. For this purpose, there is formed a longitudinally extending recess 76, 77 and 79, 80 in the lower and upper side of the respective inner bed member flanges 46, 49 and 48, 50 as seen in FIG. 3. The associated recesses 76, 79 and 77, 80 form a pocket between the respective flanges 46, 49 and 48, 50 which is located inward of where these flanges are welded to the housing shell member flanges and which is open to receive the mating inner bed member flanges. The vertical width of the pockets is sized so as to tightly but slidably receive the mating inner bed member flanges while a sufficient horizontal end clearance 81 is provided therebetween so as to permit relative sliding movement in the horizontal direction between the periphery of the inner bed members and the outer bed members and thus also between the periphery of the inner bed members and the housing shell members occasioned by relative heat expansion of these parts.

To then complete the separation of the catalyst pellets in the beds, there is formed a shoulder 82, 83 each with a recess 84, 85 extending on and across the imperforate portion 38, 42 of the respective outer bed members 32, 33 and located immediately adjacent the shallow end of the respective body portion 37, 41 of these members (see FIG. 2). The shoulders 82, 83 extend horizontally across the respective imperforate portions 38, 42 and join at opposite ends with the respective flanges 46, 48 and 49, 50 of the outer bed members. The recesses 84, 85 of shoulder 82, 83 are co-planar with the recesses 76, 77 and 79, 80 respectively, of the flanges 46, 48 and 49, 50 with which they join and are located so that the shoulder 82 engages the upper side of the flange 71 on the upper bed plate member 35 completely along its end closest the inlet 57 while the other shoulder 83 engages the lower side of the flange 72 on the lower bed plate member 36 completely along its end closest the outlet 59.

Figure 4:
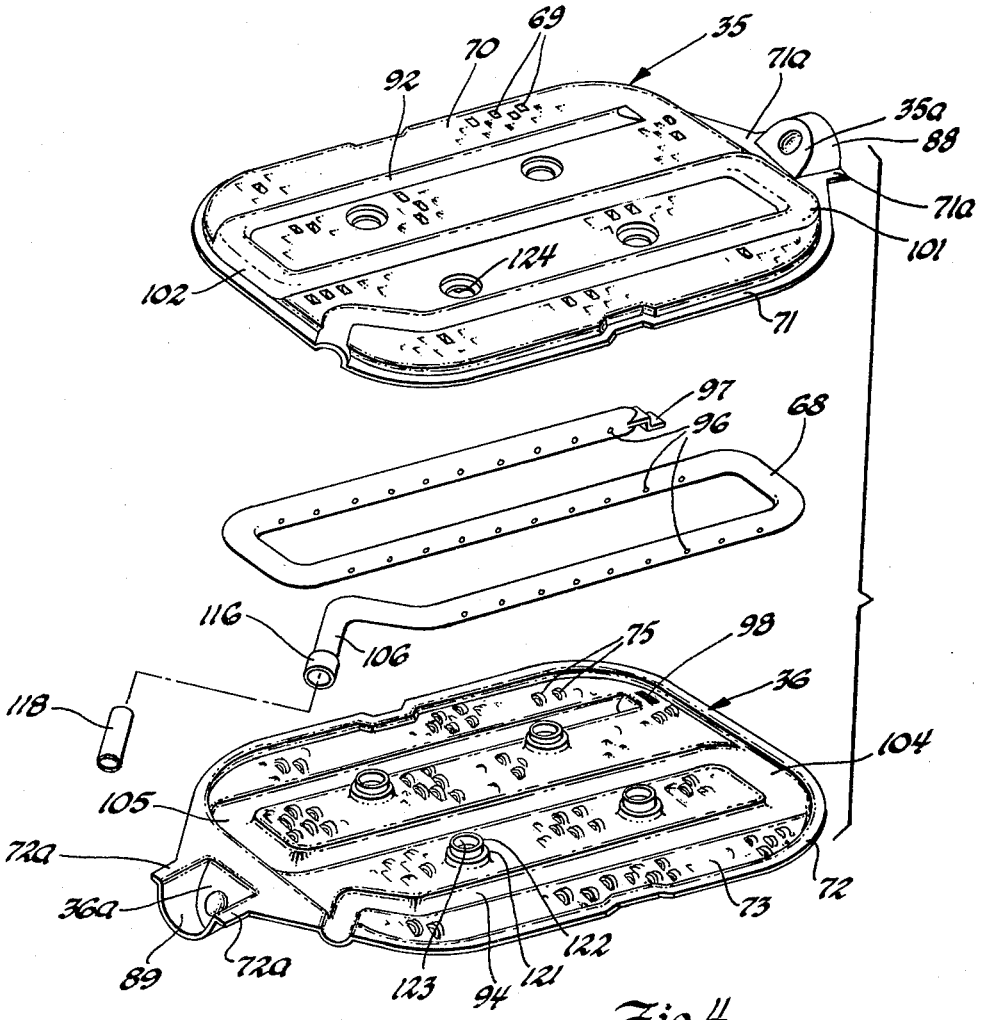
FIG. 4 is an exploded view of the inner bed members and air tube of the converter in FIG. 1.

In addition, at the one end of the respective inner bed members 35 and 36 which is opposite but does not bear directly against the respective shoulders 82 and 83, there is formed the imperforate end portion or extension **35*a*, 36*a* which extends beyond the respective peripheral flanges 71, 72 to provide for positively maintaining the flange engagement of the inner bed plate members with the respective shoulders. The extensions 35*a*, 36*a* are themselves positively retained by being formed with a semi-cylindrical neck portion 88, 89 having flanges 71*a* and 72*a* on opposite sides thereof extending from and coplanar with the respective peripheral flanges 71, 72 (see FIGS. 2 and 4). With such configuration, the neck portion 89 on the lower bed plate member 36 is made to nest on its convex side against the neck portion 40 of the lower bed shell member 33 and to nest on its concave side against the neck portion 39 of the upper bed shell member 32 inward of the neck portion 20 on the lower housing shell member 12. On the other hand, the neck portion 88 on the upper bed plate member 35 is made to nest on its convex side against the neck portion 44 of the upper bed shell member 32 and to nest on its concave side against the neck portion 43 of the lower bed shell member 33 inward of the neck portion 19 on the upper housing shell member 11. Thus, the neck portion at the one end of each of the inner bed members is sandwiched between the opposing neck portions of the outer bed members. In addition, the flanges 71*a* and 72*a* along the respective inner bed plate member neck portions 88, 89 are sandwiched between the respective outer bed shell member flanges 46, 49 and 48, 50. However, the sandwiching of the inner bed plate neck portions 88, 89 and flanges 71*a*, 72*a* is like that of the mating inner bed plate peripheral flanges 71, 72, i.e. slidable mounting between and without weldment to the outer bed members, so that the inner bed plate members 35** and 36 remain free along their entire periphery for relative heat expansion of the outer bed shell members and housing shell members. And moreover, this is accomplished with the inner bed members firmly supported along their entire periphery.

Thus, the separation of the pellets $P_{3W}$ and $P_O$ in the beds 16 and 17 is positively maintained and in particular by the cooperation of the respective outer bed member shoulders 82 and 83 with the mating inner bed member flanges 71 and 72 at the opposite ends of the inner bed members while the imperforate end portion 35*a*, 36*a* of the inner bed members and the imperforate end portion 38 and 42 of the outer bed members are left free to expand with heat relative to each other in the horizontal direction. Furthermore, it will be seen that with such shoulder engagement, the lower bed plate member 36 at its imperforate end portion 36*a* cooperates with the body portion 41 of the lower bed shell member 33 in the formation of the lower catalyst bed 17 and also provides a place at this end of the lower catalyst bed out of the flow path therethrough through which the bed can be filled with pellets through the bottom of the converter as described in detail later. In similar manner, the upper bed plate member 35 at its imperforate end portion 35*a* cooperates with the body portion 37 of the upper bed shell member 32 in the formation of the upper catalyst bed 16 and also provides a place at this end of the upper catalyst bed out of the flow path therethrough through which the bed can be filled with pellets through the top of the converter as described in detail later.

Air distribution within the plenum 74 is provided by the round air tube 68 which is S-shaped and made of stainless steel. To accommodate the S-shaped tube 68 in the plenum, both the inner bed members 35 and 36 are provided on their inner or plenum side with a double-loop, partial-cylindrical imperforate channel 92 and 94, respectively. The imperforate channels 92 and 94 are formed in the respective lower and upper side of the recessed perforated portion 70 and 73 of the respective inner bed members 35 and 36. The imperforate channels 92 and 94 extend longitudinally of the respective recessed perforated portions 70 and 73 from the end thereof closest the converter inlet 57 to the opposite end thereof closest the converter outlet 59 and then make a reverse bend and return centrally thereof. The channels 92 and 94 then make a second reverse bend and return longitudinally of the respective recessed perforated portions 70 and 73 and extend across the inner bed plate member flanges 71 and 72. The imperforate channels 92 and 94 cooperate to provide an S-shaped tube receiving cavity between the inner bed members 35 and 36 that is open on opposite sides to the plenum 74. The air tube 68 engages along its length at diametrically opposite sides with the bottom of the respective channels 92 and 94 while leaving oppositely facing side areas thereof exposed to the plenum as seen in FIGS. 2 and 3. A plurality of diametrically opposite holes 96 are formed in the thus exposed areas of the air tube at points spaced along the length thereof and are thus open to the plenum. The end 97 of the air tube within the plenum is closed by flattening thereof and is bent so that it hooks to the lower bed plate member 36 through a hole 98 provided in the recessed perforated portion 73 thereof whereby the closed end of the tube is thus restrained (see FIG. 4). On the other hand, the two bends 101, 102 and 104, 105 of the respective imperforate channels 92 and 94 have an enlarged cross-section to accommodate relative expansion with heat between the air tube 68 and the two inner bed plate members 35 and 36.

The air tube 68 where it extends outward of the plenum has an imperforate portion 106 which is tightly but slidably received between the channels 92 and 94 where they extend across the flanges 71 and 72. The imperforate tube portion 106 is bent for alignment with and mounting between channels 108, 110 formed in the respective outer bed members 32, 33. The channels 108, 110 nest with channels 112, 114 formed in the respective housing shell members 11, 12 and the open and enlarged end 116 of the S-shaped tube is then fixed and sealed to the edges of the channels 108, 110, 112, 114 and to an air delivery pipe 118 by a weld 119.

Reinforced support and spacing of the catalyst beds 16 and 17 within the housing 10 coupled with reinforcement of the latter is provided by four identical studs 120 which extend vertically through aligned openings in the sheet metal members of the housing and both of the catalyst beds. The studs are located for best effect at points spaced longitudinally of and between adjacent legs of the S-shaped air tube 68. At each of the stud locations (see FIGS. 2 and 4), the lower bed plate member 36 is formed with an upwardly projecting cylindrical neck 121 having a reduced diameter portion 122 about its stud opening 123 which is closely received by the stud opening 124 in the upper bed plate number 35. After mounting the air tube 68 between the inner bed members 35 and 36, the reduced diameter neck portion 122 is positioned to extend upward and through the stud opening 124 in the upper bed plate member 35 whereafter it is crimped over the edge thereof while the neck 121 engages the lower flat side of the upper bed plate member to maintain the height of the plenum 74 at this location. The inner bed members 35 and 36 with the air tube 68 mounted therebetween are thus piloted into alignment and fixed together at their stud openings whereafter their flanges 71 and 72 are spot-welded prior to mounting of the inner bed members with the air tube as a completed subassembly between the outer bed members 32 and 33.

The studs 120 have a short and long cylindrical portion 126, 128 of equal diameter extending inward from the respective lower and upper end thereof separated by an intermediate cylindrical portion 129 of larger diameter which serves as a spacer for the lower bed. Each of the studs 120 is first located between the lower bed plate member 36 and the lower bed shell member 33 whereafter its lower end with the short small diameter portion 126 may then be inserted downward or outward through the respective openings 130, 131 therefor in the lower bed shell member 33 and lower housing shell member 12 while the stud's upper end with the long small diameter portion 128 may then be inserted upward or outward through the respective openings 123 and 124 in the previously secured together inner bed members 36 and 35. Next, a hollow cylinder or sleeve 134 which serves as s spacer for the upper bed is mounted on the long small diameter stud portion 128 between the upper bed plate member 35 and the upper bed shell member 32. Then the upper stud end with the long small diameter stud portion 128 may be inserted upwardly or outwardly through the respective opening 136 and 138 therefor in the upper bed shell member 32 and upper housing shell member 11.

Each of the stud openings 131, 138 in the respective lower and upper housing shell members 12, 11 is located in the center of a separate substantially conical recessed area 140, 141 formed in the bottom and top of the respective housing shell members. The respective housing shell member recessed areas 140, 141 have an outwardly projecting neck 142, 143 about their stud opening 131, 138 for receiving the respective short and long small diameter stud portion 126, 128 and bear on their inner side directly against the lower side and upper side of the respective outer bed members 33, 32. In addition, the respective outer bed members 32 and 33 are formed with an upwardly projecting neck 144 and 145 about their respective stud openings 136 and 130. The necks 144 and 145 engage the respective lower and upper side of the housing shell members 11 and 12 at the recessed areas of the latter and their heights in the converter are made different to accommodate for the slant of the converter bed. For example, at the left-hand stud as seen in FIG. 2 these necks are displaced upward while those at the right-hand stud are displaced downward. A washer 148 is then located about each of the housing shell member necks 142 and 143 and against the lower and upper side of the respective housing shell members 12, 11.

The axial lengths of the large diameter stud portion 126 and the sleeve 134 are determined so that when the converter assembly is clamped together at the washers 148, the axially spaced annular shoulders 149 and 150 of the large diameter stud portion abut with the oppositely facing inner sides of the lower bed members 33 and 36 to maintain the desired spacing therebetween while the upper annular end of the sleeve abuts with the inner side of the upper bed shell member 32 and the lower annular end of the sleeve cooperates with the upper stud shoulder 150 to sandwich the two inner bed members 35 and 36 therebetween at their flanged connection to maintain the desired spacing between the upper bed members 32 and 35. With the assembly thus clamped, a continuous weld 153 is provided between the respective projecting ends of the stud, the housing necks 142, 143 and the inner diameter of the washers 148 to thus seal the converter at these stud locations while fixing the stud 120 and sleeve 134 in place to maintain the clamped condition and thus the bed spacing in addition to strengthening the housing.

Filling of the upper catalyst bed 16 is provided through the top of the converter by an opening 156, 157 in the respective upper housing shell member 11 and upper bed shell member 32 adjacent the converter outlet with the upper housing member having a downwardly projecting neck about its opening 156 which extends through and is crimped over the edge of the opening 157 in the upper bed shell member 32 as shown in FIG. 2. After the upper bed has been filled with the catalyst coated pellets $P_{3W}$, the opening thereto is closed by a sheet metal plug 159 of stainless steel. On the other hand, the lower catalyst bed 17 is filled through the bottom of the converter by an opening 160, 161 in the respective lower housing shell member 12 and lower bed shell member 33. The opening 160 in the lower housing shell member 12 is provided with an upwardly projecting neck thereabout which extends through and is crimped over the edge of the opening 161 in the lower bed shell member 33. After the lower bed has been filled with the catalyst coated pellets $P_O$, the opening thereto is closed by a sheet metal plug 163 of stainless steel.

The converter housing is insulated by two sheets 164 and 165 of heating insulating material which respectively lay across the top and bottom thereof and are held in place by a pair of sheet metal cover members 166 and 167 of aluminum coated steel and of which only the upper cover member is ribbed in the transverse direction for strength. The cover members 166 and 167 generally conform to the outer profile of the converter housing while leaving the inlet, outlet and air tube open. The cover shell members are spaced outwardly from the sides of the housing and are joined together by crimping the top cover member on the lower cover member at the welded flanges of the housing shell members and outer bed members. In addition, the cover members 166 and 167 have a fill opening 176 and 178 therethrough, respectively, and fit under the flange of the respective plugs 159 and 163 whereby the cover members are secured to the converter at these points when the plugs are inserted while leaving access through the cover for filling the catalyst beds.

The above described preferred embodiment is illustrative of the invention which may be modified within the scope of the appended claims.

The embodiments of the invention in which an exclusive property or privilege is claimed are defined as follows:

1. In a dual bed catalytic converter for internal combustion engine exhaust gases and of the type having a housing comprised of two sheet metal parts cooperatively enclosing and cooperatively forming an inlet and an outlet for a pair of catalyst pellet beds arranged face-to-face between the inlet and outlet wherein each of the beds is comprised of two sheet metal parts having louvers with the periphery of the outer part of each bed sandwiched between and sealingly fixed to the housing parts and with the inner part of each bed sealingly mating with that of the other to form an air plenum between the beds and wherein mating portions of the inner bed parts extending between the inlet and outlet are clamped but slidably movable between the outer bed parts while the remaining mating portions of the inner bed parts extending transverse of the respective inlet and outlet engage on only their inner bed side against an internal shoulder on the respective outer bed parts to completely separate the pellets in the beds: the improvement comprising in combination, a single extension integral with and extending outwardly from each of the inner bed parts toward either the inlet or outlet, the extension on each of the inner bed parts being clamped but slidably movable between the outer bed parts so as to trap the other inner bed part against the shoulder which the latter engages whereby the inner bed parts are completely peripherally supported but slidably movable between the outer bed parts.

2. In a dual bed catalytic converter for internal combustion engine exhaust gases and of the type having a housing comprised of two sheet metal parts cooperatively enclosing and cooperatively forming an inlet and an outlet for a pair of catalyst pellet beds arranged face-to-face between the inlet and outlet wherein semi-cylindrical portions on the housing parts form the inlet and outlet and wherein each of the beds is comprised of two sheet metal parts having louvers with the periphery of the outer part of each bed including a semi-cylindrical portion at both the inlet and outlet and being sandwiched between and sealingly fixed to the housing parts and with the inner part of each bed sealingly mating with that of the other to form an air plenum between the beds and wherein mating portions of the inner bed parts extending between the inlet and outlet are clamped but slidably movable between the outer bed parts while the remaining mating portions of the inner bed parts extending transverse of the respective inlet and outlet engage on only their inner bed side against an internal shoulder on the respective outer bed parts to completely separate the pellets in the beds: the improvement comprising in combination, a single extension integral with and extending outwardly from each of the inner bed parts toward either the inlet or outlet, the extension on each of the inner bed parts including a semi-cylindrical portion sandwiched between those of the outer bed parts so as to trap the other inner bed part against the shoulder which the latter engages whereby the inner bed parts are completely peripherally supported but slidably movable between the outer bed parts.

* * * * *